United States Patent [19]

Prohaska, Jr.

[11] 4,265,936

[45] May 5, 1981

[54] VEHICLE REFINISHING PROCESS

[76] Inventor: Theodore Prohaska, Jr., 6940 Winterwood La., Dallas, Tex. 75248

[21] Appl. No.: 934,853

[22] Filed: Aug. 18, 1978

[51] Int. Cl.[3] ..... B05D 1/38; B05D 3/00; B05D 7/16

[52] U.S. Cl. ..... 427/140; 427/142; 427/299; 427/309; 427/327; 427/379; 427/409

[58] Field of Search ..... 427/140, 142, 299, 309, 427/327, 379, 409

[56] References Cited

U.S. PATENT DOCUMENTS 3,713,872 1/1973 Porter et al. ..... 427/409

*Primary Examiner*—James R. Hoffman

*Attorney, Agent, or Firm*—Sigalos & Levine

[57] ABSTRACT

This invention relates to the process of repainting a vehicle surface to give controlled depth of color and high image reflection, comprising preparing the surface for reception of a color coating, applying at least one coat of an acrylic enamel color coating onto said prepared surface, drying said color coating, applying an acrylic clear paint inter-mix finish coat over the color coat, and drying said finish coating, said color coating being a mixture of an automotive acrylic enamel, acrylic thinner, and acrylic clear paint designed for inter-mixing in the formulation of a color coating in amounts to give a DuPont cup viscosity reading of between about 16 to 21 seconds at 125° F., and said color coating and finish coating being heated to a temperature of about 115°-135° F. just prior to application.

10 Claims, No Drawings

VEHICLE REFINISHING PROCESS

BACKGROUND OF THE INVENTION

Newly manufactured vehicles, such as automobiles and trucks, have painted surfaces with controlled depth of color and excellent image reflection; a uniform high gloss finish. This is due in the main to the facilities available in the manufacturing plants which permit dipping of the entire surface to be painted, such as the body, into the paint and then prompt drying of the painted surface.

With the passage of time, the original luster and shine of the painted surface is lost due to weathering and many owners desire to have their vehicles refinished. In many instances refinishing is necessary because the vehicle has been involved in an accident and the repaired area must be painted to match the color of the undamaged area.

Whatever the reason, it has been found heretofore that repainting of the car does not result in a finish that has smooth, uniform, high gloss finish of factory painted vehicles. Of course, it is not feasible to employ factory conditions, such as dipping, so consequently, repainting is primarily accomplished by spraying the paint onto the vehicle.

Some of the problems encountered in refinishing are "orange peel", "mottling", and "dry spots." "Orange peel" is used to describe the uneven, wrinkled surface resembling the outer surface of an orange, that results when the paint dries too quickly and entraps solvents beneath the surface of the paint. "Mottling" describes the uneven appearance that results when using metallic paints and drying is not carried out properly. The metallic particles, instead of being substantially uniformly distributed, tend to clump together and give a spotted or mottled appearance. The term "dry spots" is descriptive of those areas which do not receive sufficient paint as it is being sprayed onto the vehicle surface. The finish is dull in appearance in these areas.

Efforts to improve the appearance of the vehicles have included the use of improved paints and presently for best results acrylic base enamels are used for repainting. Even with such improved paints, however, the results obtained are not entirely satisfactory as to depth of color and image reflection and orange peel, mottling, and dry spots still occur.

Also used to overcome the problems of refinishing are gas-fired ovens into which the repainted vehicle is placed in order to bake the paint dry. These ovens are not only costly in terms of initial purchase cost and operation, but, further, do not overcome the problems discussed above.

SUMMARY OF THE INVENTION

The present invention overcomes the problems of the prior art and provides a process for giving refinished vehicles excellent controlled depth of color and image reflection while at the same time eliminating orange peel, mottling, and dry spots.

Briefly stated, the present invention is directed to the process of repainting a vehicle surface comprising preparing the surface for reception of a color coating, applying at least one coat of an acrylic enamel color coating onto said prepared surface, drying said color coating, applying a standard automotive acrylic clear paint inter-mix finish coat over the color coat, and drying said finish coating, said color coating being a mixture of a standard automotive acrylic enamel, acrylic thinner, and a standard automotive acrylic clear paint inter-mix in amounts to give a DuPont cup viscosity reading of between about 16 to 21 seconds at 125° F., and said color coating and finish coating being heated to a temperature of about 115°–135° F. just prior to application.

DETAILED DESCRIPTION

While present invention is applicable to all vehicles, such as automobiles, trucks, motorcycles and the like, it will be further described with particular reference to automobiles.

Also, the present invention is suitable for use with any of the various types of refinishing apparatus presently used for repainting vehicles, i.e., conventional spray guns, electrostatic sprayers, drying lamps, and the like, as will be evident from the description that follows.

The initial steps in refinishing procedures are those conventionally used to prepare the surface for refinishing. These include some or all of the following procedures: dewaxing to remove tar, silicones, oil, and grease; feathering smooth any chips and imperfections; etching bare metal with phosphate cleaner; sanding to insure adhesion; surface removal of dust and other foreign matter using high pressure air stream and hand tacking with diluted varnish; and complete surface precoating with a primer-sealer to promote adhesion and improve "hold-out." It is, of course, also conventional to mask exposed areas of the automobile that are not to be painted; such as the glass and chrome. These steps form no part of the instant invention and any of these or other procedures conventionally used to prepare an automobile surface for repainting can be used with the present invention. Since this invention requires the use of an acrylic enamel color coating, as set forth below, the primer and sealer should be any of the standard formulated primers and sealers suitable for use with automotive acrylic enamel color coatings. Preferably, a conventional non-sanding combined primer-sealer is used.

After the primer-sealer has been applied and dried the color coating is then applied. It is essential in the instant process that the color coating contain, as the paint, automotive acrylic enamel and that it be applied while at a temperature of about 115° to 135° F., most suitably about 125° F. Any acrylic enamel paint made for automobile repainting can be used. The color coating must include other components to provide a suitable refinish and a certain viscosity after heating; a viscosity reading on a standard DuPont cup of about 16 to 21 seconds (preferably about 17 seconds).

The heating can be carried out in any device having means for regulating temperature and protecting against ignition of the solvents in the paints and thinners. Within the range of 115° to 135° F. to which the paint mixture is heated, it is preferred to use a temperature about 30° to 50° F., preferably about 40° F., higher than the ambient temperature of the area where the paint is to be applied.

To provide for a uniform high gloss finish and to adjust the viscosity of the acrylic enamel requires admixing with the enamel of a conventional acrylic thinner; one designed for temperature ranges of 85° to 100° F., and an acrylic clear enamel inter-mix. Such intermixes have no pigment, but are toners, and any of those made for use in automotive finishing can be used. It is preferred to use a clear inter-mix containing no drier.

With conventional automotive acrylic enamels it has been found that, on a volume basis, for each 100 parts thereof, suitable results and viscosity after heating can be obtained by admixing therewith at least 20 parts of any conventional compatible clear inter-mix and about 20 to 30 parts, preferably 25 parts, of thinner. Again, the thinner, or reducer, can be any ordinarily used to thin automotive acrylic enamels. The upper limit of the clear inter-mix is governed by the viscosity desired and color desired. Too much clear inter-mix, above about 40 parts, will dilute the color of the acrylic base enamel and give an unsatisfactory appearance.

As in conventional procedures drying catalysts for acrylic enamels can also be added to the color coating. However, if used, they are added in proportions much lower than ordinarily used. Customarily, one pint (16 fl. oz.) of catalyst is used for each gallon of enamel. In the instant invention only about one ounce per gallon of enamel is used. The polyurethane catalysts are most suitable and these ordinarily contain aliphatic polyisocyanates, xylene, and ester solvents.

The acrylic color coating after admixture and being heated to the proper temperature (about 115° to 135° F.) is applied, as by spraying, onto the previously primed and sealed surface. Here again, the spraying pressures are conventional, about 65 psi, and two coats are ordinarily applied. For nonmetallic color coatings the first coat is put on dry (thin) and the second coat wet (thick). For metallic enamels the first coat is put on wet and the second dry.

The coats are air dried and then the finish coat is applied. Air drying is sufficient in the instant invention thus eliminating the need for baking ovens. This results in significant cost savings in refinishing.

The finish coat can, again, be any of the usual clear inter-mixes described above. It is preferable to thin the inter-mix with acrylic thinner in an amount sufficient to give a viscosity reading of about 18 seconds on a DuPont viscosity cup. In accordance with the present invention, however, it must be applied in a heated condition; i.e., about 115° to 135° F., preferably about 125° F. This coat is then air dried and the refinishing is complete. The use of the inter-mix as the finish coat eliminates the need to use the more expensive and conventional top coats that are used and thereby also shortens drying time and the need to have baking ovens to dry the top coat.

The invention will be further described in connection with the following example in which proportions are by volume unless expressly stated to the contrary.

EXAMPLE

A wet coat of HI-GLO SYNTHETIC, 711 Non-Sanding, Gray Primer by Western Specialty Coatings Company (hereinafter "Western"), a primer-sealer, is sprayed onto the prepared surface of an automobile at 65 psi. This coat is air dried in twelve minutes at about 85° F. ambient temperature. If the humidity exceeds 70%, the drying time should be increased about five mintues.

One gallon of WESCRYL acrylic enamel by Western is admixed with about one-fifth gallon of WESCRYL acrylic enamel inter-mix (6895 Polymeric clear-no drier by Western), one ounce of polyurethane catalyst (U-768 by Western) and 32 ounces of acrylic enamel thinner (SRA-15 SLOW by Western).

The viscosity reading on a DuPont cup of the mixture is 18 seconds. The mixture is then heated to 125° F. and the viscosity reading on a DuPont cup after heating is 17 seconds.

The enamel color coat mixture used is non-metallic and two coats are applied by spraying at 65 psi; the first coat dry and the second wet. The coats are air dried in eight minutes. Longer drying times are required at humidities above 70%.

Finally, one-half gallon of the same inter-mix used in the color coat is mixed with 16 ounces of acrylic enamel thinner; again, Western SRA-15 SLOW. The viscosity on a DuPont viscosity cup is 18 seconds.

This mixture is then heated to 125° F. and one coat sprayed onto the painted surface as a top coat at 65 psi. It is air dried for fifteen minutes.

The result is a refinished vehicle surface that has controlled color depth and excellent image reflection; a uniform high gloss finish free of wrinkles and dull spots.

The uniquely formulated color coating, heating of such color coating and finish coating to temperatures of 115° to 135° F., and the use of an inter-mix as the finish coat in place of the conventional top coat surprisingly result in refinished vehicle surfaces free of orange peel, dry spots, and mottling and which have a uniform high gloss. All this is accomplished while at the same time using conventional sprays and eliminating the need for drying ovens to dry the various coats.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. The process of repainting a vehicle surface comprising preparing the surface for reception of a color coating, applying at least one coat of a color coating onto said prepared surface, drying said color coating, applying a standard automotive clear paint toner finish coat over the color coat, and drying said finish coating, said color coating being a mixture of a automotive acrylic enamel, acrylic thinner, and a automotive clear paint toner in amounts to give a DuPont cup viscosity reading of about 16 to 21 seconds at 125° F., and said color coating and finish coating being heated to a temperature of about 115°–135° F. just prior to application.

2. The process of claim 1 wherein said color coating also contains a polyurethane drying catalyst for acrylic enamel.

3. The process of claim 1 wherein said color coating contains for each 100 parts by volume of acrylic enamel, at least 20 parts of said toner, and 20 to 30 parts of said acrylic thinner.

4. The process of claim 3 wherein said color coating is heated to a temperature of about 125° F. just prior to application.

5. The process of claim 1 wherein the finish coating is a mixture of said toner and sufficient acrylic thinner to give the mixture a viscosity of about 16 to 21 seconds on a DuPont viscosity cup at 125° F.

6. The process of claim 5 wherein said finish coating is heated to a temperature of about 125° F. just prior to application.

7. The process of claim 1 wherein each coating is air dried prior to application of any subsequent coating.

8. The process of repainting a vehicle or any portion thereof comprising:

(a) preparing the surface to be repainted for reception of a color coating, (b) applying at least one coat of a color coating heated to about 125° F. onto said prepared surface, said color coating consisting essentially of 100 parts by volume of a automotive acrylic enamel, at least about 20 parts of an acrylic clear paint toner, about 25 parts of acrylic thinner, and about 0.8 parts of a polyurethane drying catalyst for said acrylic enamel, to give a viscosity of 17 seconds on a DuPont viscosity cup, (c) air drying said color coating, (d) applying a finish coating heated to about 125° F. over said dried color coat, said finish coating comprising 100 parts by volume of acrylic paint toner and 25 parts acrylic thinner to give a viscosity of 18 seconds on a DuPont viscosity cup, and (e) air drying said color coating.

9. The process of claim 8 wherein two color coats are applied; one coat thicker than the other.

10. The process of claim 1 wherein the temperature differential between ambient temperature and temperature to which the color coating and finish coating are heated is between about 30° to 50° F.

* * * * *